US006260466B1

(12) United States Patent
Humphreys

(10) Patent No.: US 6,260,466 B1
(45) Date of Patent: Jul. 17, 2001

(54) TARGET AIMING SYSTEM

(75) Inventor: David Kerr Paterson Humphreys, East Kilbride (GB)

(73) Assignee: Barr & Stroud Limited, Glasgow (GB)

( * ) Notice: Subject to any disclaimer, the term of this patent is extended or adjusted under 35 U.S.C. 154(b) by 0 days.

(21) Appl. No.: 09/269,890

(22) PCT Filed: Sep. 22, 1997

(86) PCT No.: PCT/GB97/02546

§ 371 Date: Apr. 2, 1999

§ 102(e) Date: Apr. 2, 1999

(87) PCT Pub. No.: WO98/14747

PCT Pub. Date: Apr. 9, 1998

(30) Foreign Application Priority Data

Oct. 3, 1996 (GB) ..... 9620614

(51) Int. Cl.[7] ..... F41G 3/08
(52) U.S. Cl. ..... 89/41.06; 89/41.05; 89/41.03
(58) Field of Search ..... 89/41.01, 41.03, 89/41.05, 41.06, 41.19

(56) References Cited

U.S. PATENT DOCUMENTS

| | | | | |
|---|---|---|---|---|
| 4,008,869 | | 2/1977 | Weiss . | |
| 4,015,258 | | 3/1977 | Smith et al. . | |
| 4,333,106 | * | 6/1982 | Lowe | 358/107 |

FOREIGN PATENT DOCUMENTS

| | | | | |
|---|---|---|---|---|
| 2827856 | * | 1/1980 | (DE) | 89/41.06 |
| 32 36 206 | | 12/1983 | (DE) . | |
| 3504198 | | 8/1986 | (DE) . | |
| 0 105 432 | | 4/1984 | (EP) . | |
| 0 226 026 | | 6/1987 | (EP) . | |
| 1419471 | * | 12/1975 | (GB) | 89/41.06 |
| 136400 | * | 11/1978 | (JP) | 89/41.05 |
| 92 19928 | | 11/1992 | (WO) . | |

* cited by examiner

*Primary Examiner*—Stephen M. Johnson
(74) *Attorney, Agent, or Firm*—Alston & Bird LLP

(57) ABSTRACT

Assessing the accuracy with which a round fired from a gun hits an intended target is achieved and alignment of the gun is corrected by monitoring the target with an image sensor which is associated with a computer enabling a frame by frame analysis and comparison of the fired round's trajectory with computer-generated alternative trajectories.

11 Claims, 5 Drawing Sheets

TARGET AIMING SYSTEM

FIELD OF THE INVENTION

The present invention relates to target aiming systems.

BACKGROUND OF THE INVENTION

In a battle situation it is necessary for a gun crew to be able to assess the accuracy with which rounds fired by their gun are hitting intended targets. Conventionally, this assessment has been carried out visually with the aid of binoculars or a telescope. However, visual assessment of this type is of limited use because of the momentary nature of the event being observed and because the resulting cloud of smoke and dust which is raised by the resultant explosion can easily obscure the point of impact. It is also often the case that when an incoming round has landed close to a target such as a tank, the tank crew will rapidly fire off smoke bombs to obscure them from the attacking gun, again obscuring the view of the observer. Furthermore, the observer's line-of-sight can be interrupted by smoke and dust thrown up by his own gun and by vibration produced on firing the gun.

It is known to use an image sensor (typically a thermal imager) mounted on a gun and directed at the target to record continuously while the gun is being fired. The video sequence recorded can be viewed subsequently in an attempt to assess the accuracy of fired round. The gun operator can then attempt to correct any gun targeting errors by realigning the gun barrel. However, the transient nature of the firing and impact events, as well as the relatively small size of a fired round, makes it extremely difficult for the operator to view the trajectory of the round and the point of impact. The subjective nature of this process leaves open the possibility of significant human errors being introduced in the realignment stage.

A further disadvantage if this system is that it generates a large amount of recorded data which must generally be stored on video tape, an unreliable storage medium under battlefield conditions. Whilst solid state memory may be used, this is expensive where it is required to store a long video sequence or a large number of sequences to be stored for later historical analysis. Furthermore, in order to identify that portion of the video sequence which shows the round passing or hitting the target, perhaps only one or two frames of the video sequence, the gun crew must review a relatively large number of frames. In a battle situation, the time wasted studying the sequence can be critical.

SUMMARY OF THE INVENTION

It is an object of the present invention to overcome or at least mitigate the disadvantages of known target aiming systems.

According to a first aspect of the present invention there is provided a method of correcting the alignment of a gun following the firing of a round at a target by the gun, the method comprising the steps of:

- aiming the gun at the target and predicting an expected trajectory for a round to be fired
- firing the gun and monitoring the target and its surrounding area with an image sensor;
- predicting a plurality of alternative round trajectories which encompass possible variations from said expected trajectory;
- analysing image data generated by the image sensor to determine which of said trajectories the fired round followed and, if it is determined that the fired round followed one of said alternative trajectories, determining a gun alignment correction factor (for use with a subsequent round) from a comparison of the followed trajectory and said expected trajectory.

In a preferred embodiment of the present invention, the image sensor provides a sequence of image frames which together form a video record of the travel of the fired round and said step of analysing the image data comprises normalising the frames to subtract stationery background therefrom and then for each said trajectory:

- mapping the trajectory onto the two-dimensional plane of the image frames;
- for each frame predicting the displacement of a round following the trajectory, relative to a fixed reference point;
- translating the frames of the sequence relative to said fixed reference point by the respective predicted displacements;
- summing the translated frames to generate a single cumulative frame;
- identifying features present in the cumulative frame which exceed a threshold level and which have a form chosen to be indicative of a fired round.

Typically, for the cumulative frame corresponding to the actual round trajectory, the fired round will appear as a bright spot, having a gaussian intensity distribution.

If for one of the trajectories a feature is identified in the cumulative image which exceeds said predetermined threshold then that trajectory is identified as the trajectory followed by the round. If features are so identified for a number of different trajectories, then the feature having the strongest intensity is selected and the associated trajectory identified.

Said video record may contain any appropriate number of image frames and may encompass a part or all of the travel of the fired round from gun to target.

The preferred embodiment described above may be modified so that, instead of considering each frame in its entirety, only a portion or patch of each frame predicted to contain the round, is considered. This patch will be of the same extent for each frame and it is only necessary to translate and sum the identified patches, considerably reducing the complexity of the image processing operation.

It will be appreciated that the field of view of the image sensor should be arranged such that it encompasses all or at least a part of each of the possible trajectories of a fired round.

According to a second aspect of the present invention there is provided a method of determining the site of impact of a round fired by a gun at a target, the method comprising:

- monitoring and recording the target and its surrounding area with an image sensor;
- defining a threshold level of change in the output of the image sensor as being indicative of an impact of a round;
- following the firing of a round, detecting a change in the output of the image sensor in excess of said defined threshold and identifying the region of change; and
- determining the centroid of said region of change and identifying this centroid as the site of impact of the fired round.

The detected change in the output of the image sensor may be determined relative to the preceding image frame in a sequence of image frames. Alternatively, the change may be determined relative to an image recorded prior to firing of the round.

According to a third aspect of the present invention there is provided a target hit assessment method for enabling a gun crew to determine the accuracy of a round fired by a gun, the method comprising:

estimating prior to firing the time-to-impact of the round, with reference to the time of firing of the gun, from the properties of the round and the gun and the prevailing atmospheric conditions; and following firing of the gun, commencing recording of a video sequence of the target shortly before the estimated time-to-impact of the round and subsequently stopping recording shortly after the estimated time-to-impact; and playing back the recorded sequence in slow motion on a video display to allow the accuracy of the firing to be quantified.

The method of the above third aspect provides a method which presents only minimal data storage requirements which can be satisfied for example by a compact solid state memory and which, because the recorded video sequence represents only a relatively short time window around the estimated time-to-impact, allows the gun crew very quickly to quantify the accuracy of the round fired.

The length of the video sequence recorded is determined in part by the accuracy with which the time-to-impact of the round can be estimated. Typically however, the video sequence will comprise less than 50 frames and, more preferably, less than 10 frames. Given the relatively short length of the sequence, the sequence can be played back, slowed down by a factor or 20 or more.

It will be appreciated that elements of the above third aspect of the present invention may be incorporated into the method of the first and second aspects. In particular, from a knowledge of the time of firing of the gun, and using the estimated time-to-impact, an estimate of the relative time at which the round will enter the image sensor's field of view may be made. Searching of the field of view of the image sensor for the fired round may be commenced only shortly before the estimated entry time and may be stopped shortly thereafter. Thus, the risk of rogue images triggering the tracking procedure may be reduced.

According to a fourth aspect of the present invention there is provided a target hit assessment system for enabling a gun crew to determine the accuracy of a round fired by a gun, the system comprising:

an image sensor having a field-of-view capable of including an intended target;

computer means for estimating the time-to-impact of a round to be fired by the gun with reference to the time of firing of the gun;

video recording means coupled to the image sensor and arranged to record a video sequence from the image sensor commencing shortly before the estimated time-to-impact of a fired round and stopping shortly after the estimated time-to-impact; and video display means coupled to the video recording means for receiving therefrom said recorded video sequence for playback in slow motion.

Preferably, said image sensor is a thermal image sensor which is capable of detecting the hot rear end of a shell or other munition.

BRIEF DESCRIPTION OF THE DRAWINGS

For a better understanding of the present invention and in order to show how the same may be carried into effect, reference will now be made, by way of example, to the accompanying drawings in which.

DETAILED DESCRIPTION OF THE DRAWINGS

Figure 1:
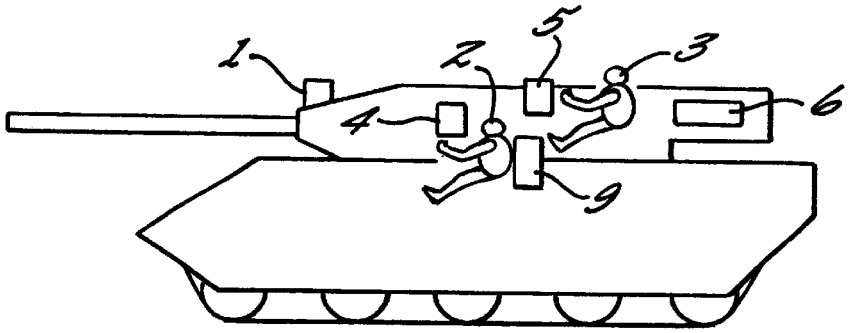
FIG. 1 shows schematically a tank incorporating a target aiming system.

There is shown in FIG. 1 a tank having a thermal imaging sensor 1, operating in the 8–12 micron window (i.e. a portion of the infra-red region), mounted on the tank's turret near the breach end of the gun barrel. The image sensor 1 moves with the turret and it is aligned with the gun barrel so that the sensor's field-of-view includes a target at which the gun is aimed. Both the tank gunner 2 and the tank commander 3 are seated behind respective video displays 4,5 which, in normal use, display the video images generated by the image sensor. The video field refresh rate, i.e. the rate at which consecutive frames are captured, is normally 50 per second which allows the tank gunner to initially aim the gun at a target, e.g. using an on-screen cursor or the like.

When the gun is fired, the tank gunner and commander may be able to determine whether or not a target has been hit by looking at the real-time displays for a secondary explosion. However, if the target is hit and no such secondary explosion occurs, or the round fired by the gun misses its target, it is unlikely that they will be able to determine from the real-time display exactly where the round impacted, or by how much it missed the target, particularly as a large plume of smoke and dust is likely to be thrown up by the explosion and because of the vibration and smoke caused by the action of firing the gun.

Figure 2:
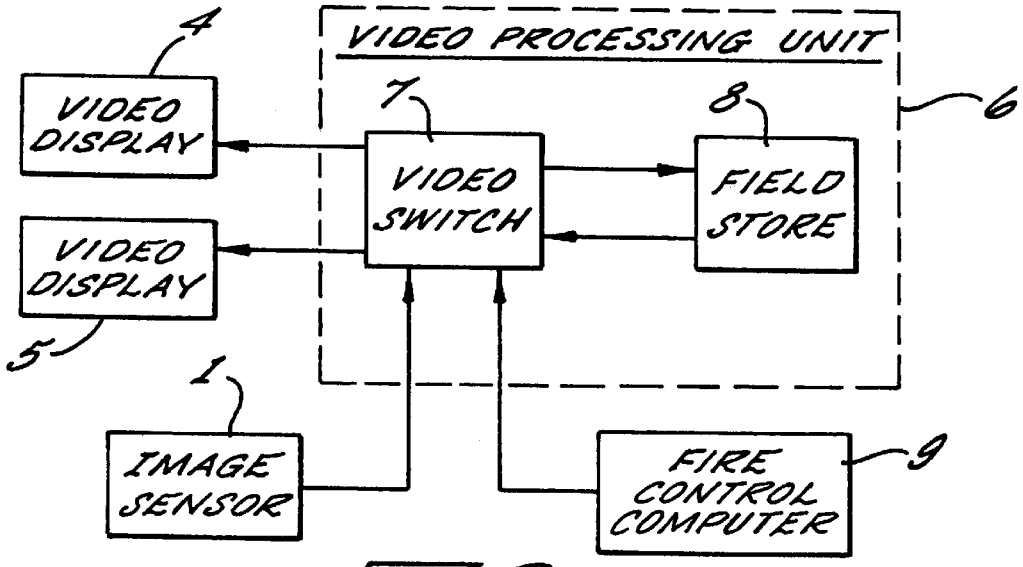
FIG. 2 shows in block diagram form the target aiming system of FIG. 1.

In order to enable the accuracy of hit assessment to be increased, the image sensor 1 is connected to a video processing unit 6 mounted in the rear of the tank's turret. The video processing unit 6 is shown in more detail in FIG. 2 and comprises a video switch 7 which interfaces the image sensor 1 to the video displays 4,5 and to a field store 8. The field store comprises a solid state memory (not shown) which has a capacity of 10 Mbytes, large enough to store 20 frames.

The video switch 7 is controlled by a fire control computer 9, the primary function of which is to determine the orientation which the gun barrel should be positioned in, in order to hit a target identified by the tank's gunner. The identification may be carried out, for example, using a laser targeting system. From the target identification data, and using data stored regarding the expected velocity and dynamics of the round, the prevailing atmospheric conditions detected by external sensors, barrel bend etc., the fire control computer 9 is also arranged to calculate the time-to-impact (t.to.i) of the shell with reference to the time of firing of a shell.

Figure 3:
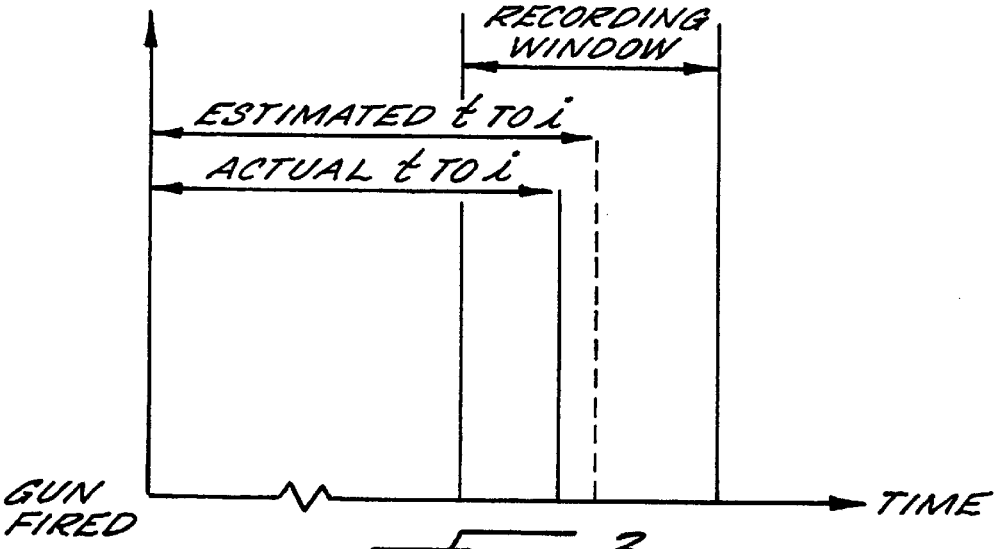
FIG. 3 illustrates the timing sequence of the hit assessment system of FIGS. 1 and 2.

In normal operation, the video switch 7 is arranged to couple the output from the image sensor 1 to the video displays 4,5 to provide a continuous display of the target area on these displays. The output from the image sensor is not normally provided to the field store 8. From the calculated time-to-impact data, the fire control computer 9 is able to identify a relatively short time window during which a fired shell is likely to impact on the target and during which images of the target need to be captured. The accuracy with which the impact estimate can be made is relatively high, normally being to within a few milliseconds, such that the time window need only be in order of 50 to 100 milliseconds to ensure that the event is captured. Thus, a short time (e.g. 5 milliseconds) before the estimated impact, the fire control computer 9 sends a signal to the video switch 7 which causes the output from the image sensor 1 to be transmitted to the field store 8 as well as to the video displays 4,5. The frames captured during the window are stored in the solid state memory of the field store 8. At the end of the time window, the fire control computer 9 sends a further signal to the video switch 7 causing the transmission of the output from the image sensor 1 to the field store 8 to cease. The timing of this sequence of events is illustrated in FIG. 3.

Following firing of the gun, if the tank gunner or the tank commander wish to assess the accuracy of the firing, they can operate the fire control computer 9 to cause the video switch 7 to couple the video sequence stored in the field store 8 to the displays 4,5. The fire control computer enables the stored sequence to be played back at any appropriate rate, e.g. frame by frame or slowed down by a factor of, for example, 20. With the image sensor 1 having a video field refresh rate of 50 frames per second, and a projectile residual velocity normally between the limits of 500 to 1500 meters per second, a round will travel between 10 and 30 meters between consecutive frames which is slow enough to ensure that the tank crew can track the final moments of the flight of the round from the slowed round during playback, particularly when the image sensor 1 is an infra-red sensor such that the hot rear end of the round will be clearly visible in flight. In particular, the crew can approximately identify that frame which shows the round in or nearest to the vertical plane in which the target lies and determine therefrom the polar distance of the target from the tank. Alternatively, if the round lands short of its target, the crew can identify the actual point of impact of the round and quantify the offset from the target. In either case, the information gained can be used to realign the gun barrel before a further round is fired at the target.

Figure 4:
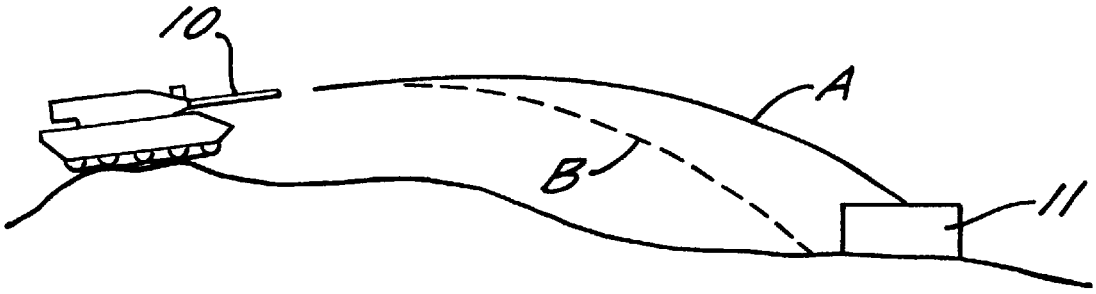
FIG. 4 illustrates predicted and actual trajectories for a round fired from a tank at a target.

The hit assessment system described above enables what is essentially a manual gun realignment process to be carried out. There will now be described with reference to FIGS. 4, 5A and 5B an automatic gun realignment system which makes use of the thermal imaging sensor 1 provided on or near the tank turret and which provides automatic tracking of a fired round across the field of view of the sensor.

As described above, it is possible for the computer 9 to estimate the time-to-impact of a fired round using target identification data, data relating to the expected velocity and dynamics of the round, the prevailing atmospheric conditions, etc. Using these same parameters, it is possible for the computer 9 to predict a trajectory for the round, between the muzzle or exit end of the gun barrel 10 and the target 11 which will result in the target being hit. This trajectory is indicated by the letter A in FIG. 4 which illustrates a possible battlefield situation. In practice, certain unpredictable factors may cause the round to deviate from this predicted trajectory A onto some other trajectory, e.g. as indicated by the letter B in FIG. 4, which results in the round missing its target. Trajectory B can be determined from the data gathered by the image sensor 1.

Figure 5A:
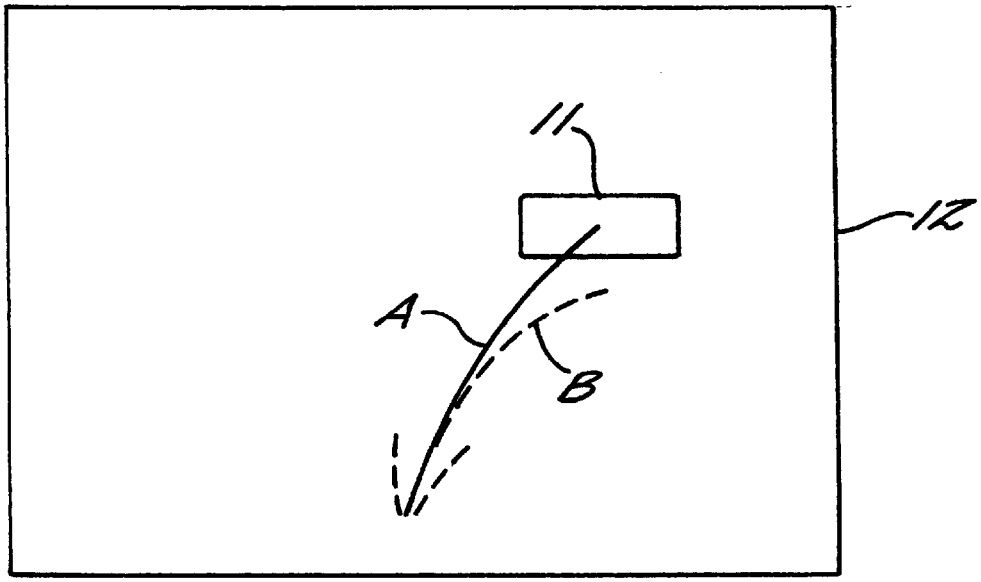
FIG. 5A illustrates the predicted and actual trajectories of FIG. 4 as viewed from an image sensor mounted on the turret of the tank.
Figure 5B:
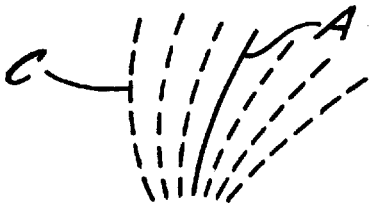
FIG. 5B shows an enlarged detail of FIG. 5A.

FIG. 5A illustrates schematically the field of view 12 of the thermal image sensor 1 mounted on the tank turret. The trajectories A, B shown in FIG. 4 can be mapped onto the 2-dimensional plane of this field of view as illustrated. From a knowledge of the deviation of the fired round from the predicted trajectory, it is possible for the computer 9 to evaluate the extent to which the gun barrel must be realigned in order to hit the target. For example, of the round falls to the right or left of the expected trajectory, the azimuthal angle of the gun barrel is corrected and, if the round falls in front of or behind the target, the elevational angle of the barrel is corrected.

Determining the actual trajectory B of a fired round however is not a simple procedure as a relatively large sequence of image frames, generated by the image sensor must be searched for a relatively small object moving at high speed. Moreover, other distracting events may be occurring in the field of view and a part of that field may be obscured by smoke and/or dust. Rather than conduct an exhaustive search of successive image sensor frames for a round entering the field of view, therefore, a search is only conducted along the predicted or primary trajectory A and along a plurality of secondary trajectories C adjacent to the primary trajectory A as illustrated in FIG. 53. The secondary trajectories C deviate from the primary trajectory A up to a maximum extent which represents a predicted maximum possible deviation of the round from the primary trajectory A.

Figure 6:
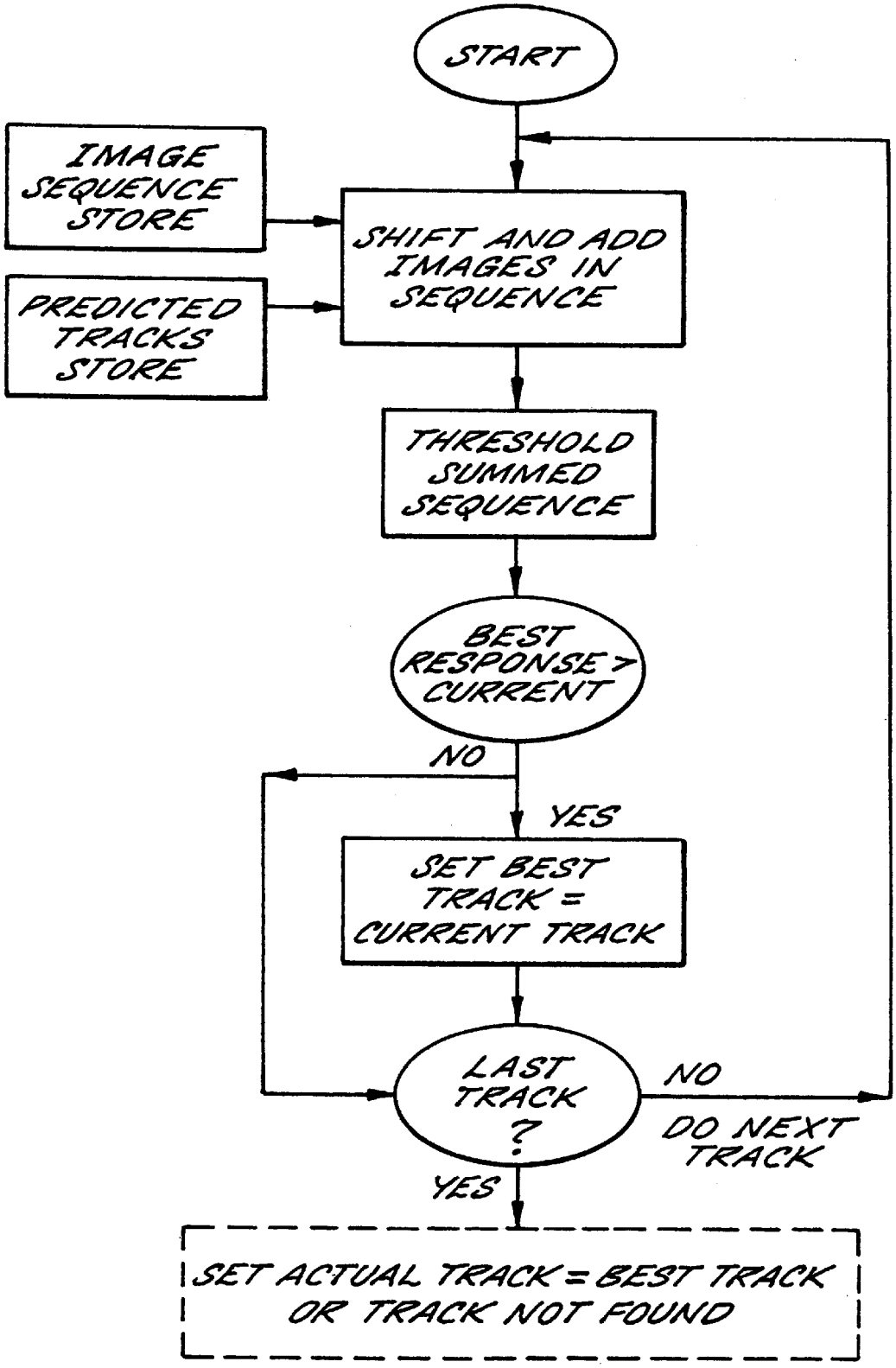
FIG. 6 shows a flow diagram of a trajectory identification process.

FIG. 6 is a flow diagram illustrating a process for identifying the actual trajectory B from a number of predicted trajectories A and C. A sequence of image frames depicting the travel of a fired round towards the target are recorded and stored in an image sequence store. The stored image frames are normalised by, for example, subtracting the first image frame from each of the subsequently obtained image frames. The resulting normalised image frames contain only data which is indicative of changes occurring relative to the first image frame. If necessary, in order to ensure that the background remains stationary, the image frames may be compensated for gun motion and vibration.

The predicted trajectories are stored in a predicted tracks store. For a first of the predicted trajectories or tracks, the three dimensional trajectory is mapped onto the two dimensional field of view of the image sensor. This enables the position of a round following the predicted trajectory to be identified in each of the recorded and stored image frames.

The process which is used to predict a round's position in each frame of the image sequence for a given trajectory employs standard ballistic and projection geometry calculations. Firstly, standard calculations using round-ballistics, platform position and attitude, platform motion, environmental conditions, time-of-shot, barrel bend, and image frame timing, are used to determine the position of the round in global coordinates. Secondly, standard projection theory calculations are used to transform predicted round positions in the three dimensional global coordinate system to the two dimensional coordinate system of the image sensor field of view. Thus it is possible to predict the position of the round in each frame of the image sequence.

Only those frames which are predicted as containing a fired round are considered. For each frame, the displacement of the round relative to a fixed reference point, for example the position of the round in the first frame containing the round, is determined. The frames are then translated or shifted by an amount corresponding to this displacement. It will be appreciated that if the fired round is actually following the predicted trajectory then the round in each frame will be translated back to the fixed reference point. The shifted frames are then summed. Again, it will be appreciated that if the fired round is following the predicted trajectory then the summed cumulative image frame will contain a high intensity 'integrated' round signal or feature at the fixed reference point. Similarly, it will be appreciated that if the actual trajectory does not coincide with the predicted trajectory then the images of the round in the image frames will not be translated to the same point and will therefore not sum cumulatively to produce a satisfactory integrated round signal. Rather, the result will be a low intensity, smudged, sub-image or area surrounding the fixed reference point.

The region surrounding the fixed reference point is examined to identify whether or not a satisfactory round signal is present at that point, which has an intensity exceeding a predetermined threshold intensity. The shape of the signal may also be examined and compared with a reference signal which has the expected shape of a round in flight.

The process is then repeated for the second predicted trajectory. If a signal is identified in the resulting cumulative image at the fixed reference point and which exceeds the predetermined threshold (and which has the chosen form), then it is compared against the signal identified for the first trajectory (if indeed such a signal was identified). If the subsequently obtained signal is a better match for a shell in flight than the previously determined signal then the second trajectory is selected as the present best trajectory. Otherwise, the first trajectory is kept as the best trajectory. This process is repeated in turn for all of the remaining trajectories to determine which of the predicted trajectories best matches the actual trajectory.

Having determined the actual trajectory which the fired round has followed, a gun alignment correction factor can be determined by comparing the actual trajectory against the primary predicted trajectory A. Typically, the deviation of the round from the primary trajectory is determined for each image frame of the recorded sequence. A new trajectory is then calculated which, when the calculated deviations are taken into account, will result in the primary trajectory A being achieved when a further round is fired.

Valuable information concerning firing accuracy may be gained by determining the precise impact site of a fired round. Providing that the process described above is able to track a fired round to impact, the impact site will be that region where the round is observed to stop travelling. However, a preferred way of identifying the impact site is to monitor the sensed image, and in particular the region of that image containing the target, for a change indicative of an explosion. The number of image frames searched for this change is preferably confined to those captured close to the estimated time-to-impact (see FIG. 3) in order to reduce the risk of error.

Figure 7:
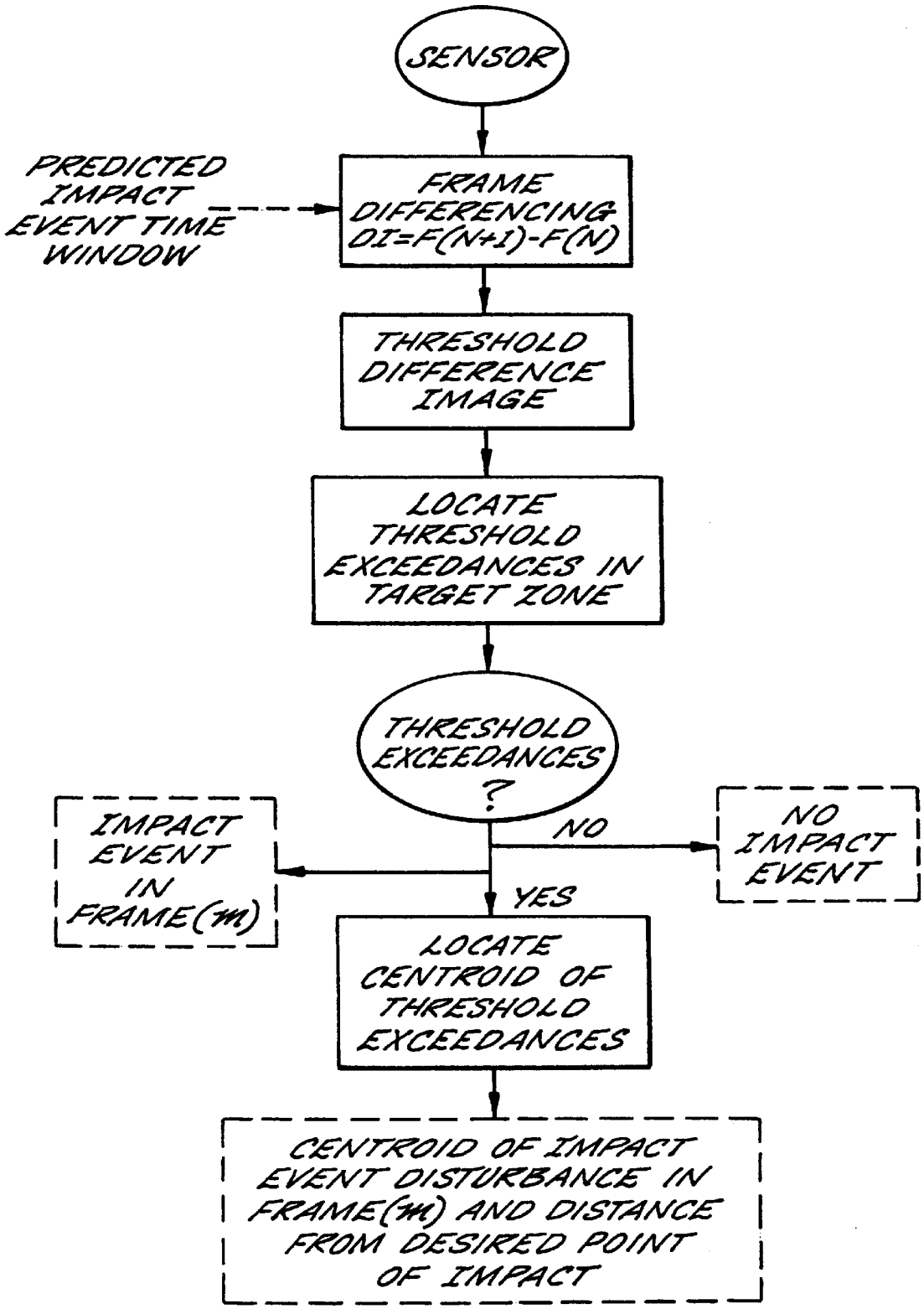
FIG. 7 shows a flow diagram of an impact detection process.

There is shown in FIG. 7 a flow diagram of a process for identifying the impact site of a fired round. Using the process described above, a window is defined around an estimated time to impact. Frames are captured from the image sensor during this window. Consecutively received image frames are subtracted from one another such that each time a new frame is obtained a new difference frame is also derived. The difference frames are indicative of changes occurring between the associated consecutive frames given that the subtraction operation removes stationary background. The difference frames are examined to identify patches of intensity exceeding a predetermined threshold intensity. The first difference frame which exhibits a change in excess of a predetermined threshold level is used to determine the location of the impact event. More particularly, the impact location is determined by applying a centroid calculation process to the region of change.

The above process may be modified by computing for each captured image frame a difference frame by comparing each image frame against a reference frame obtained for example prior to firing of the gun.

It will be appreciated that the impact site detection process may be used in combination with the trajectory tracking process and the video playback facility described earlier.

Figure 8:
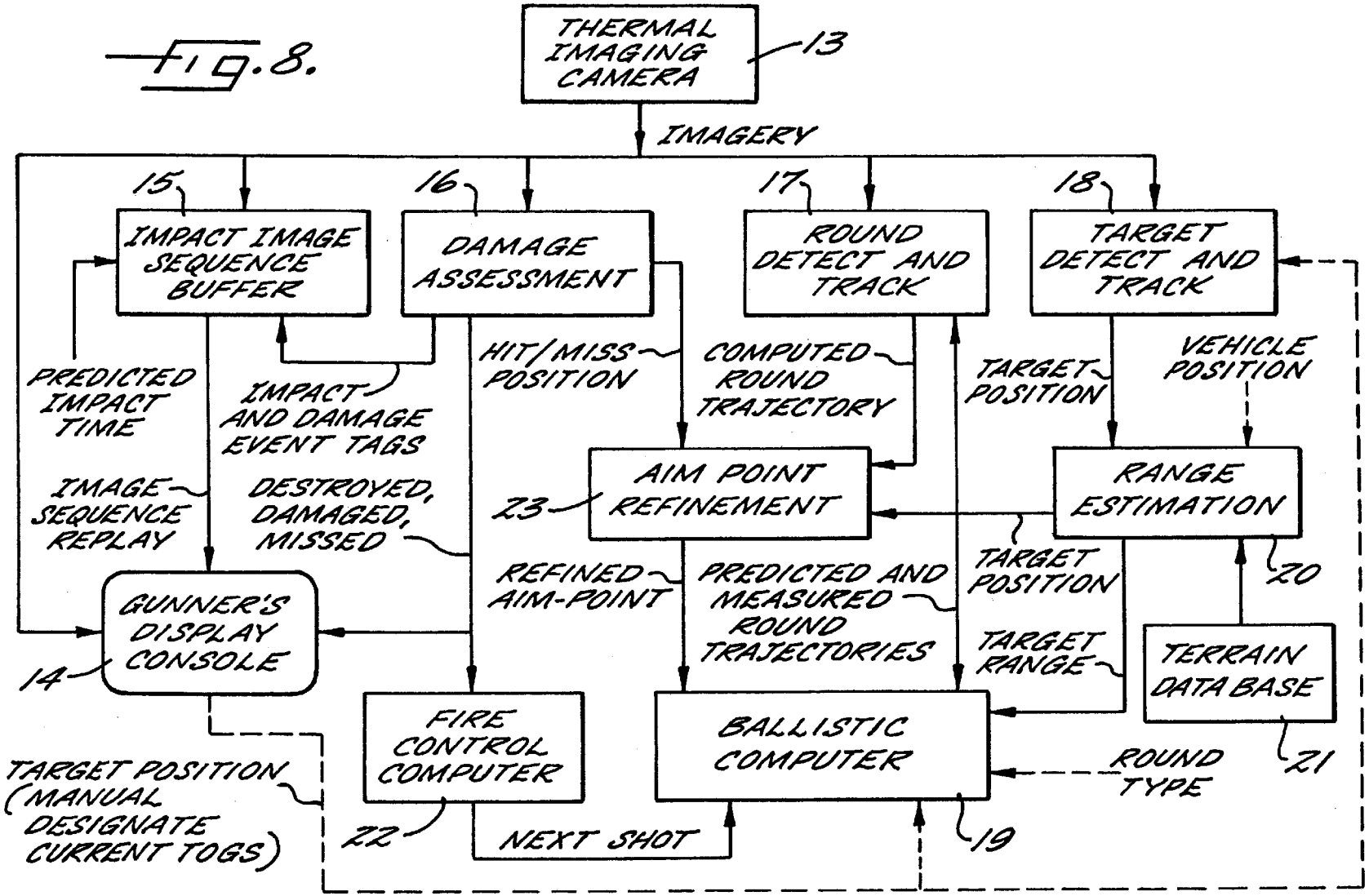
FIG. 8 illustrates schematically the organisation of a fire control system for a tank.

A possible architecture for such a combined system is illustrated in FIG. 8. The thermal imaging sensor or camera 13 relays captured image frames to the gunner's display 14 and to an impact image sequence buffer 15. Selected frames are stored in the buffer 15 and can be played back on the display 14. Image frames are also relayed to a damage assessment processor 16 which determines the impact site of a fired round, a round detect and track processor 17 which determines the actual trajectory of a fired round, and to a target detect and track processor 18 which is used to determine motion of a selected target.

A gunner selects a target on his display 14. A ballistic computer 19 then predicts the trajectory of a round in order to hit this target, using data obtained by a range estimation system 20 and data from a terrain database 21, and the gun barrel alignment necessary to achieve this trajectory. Under the control of a fire control computer 22, a round is then fired. The fire control computer 22 estimates the time-to-impact for the fired round, and causes the buffer 15 to store frames in a window surrounding the time-to-impact. The fire control computer 22 also triggers the damage assessment and round detect and track processors 16, 17 to look For impact and to track the fired round. This information is subsequently passed to an aimpoint refinement processor 23 which recalculates the gun barrel orientation necessary to hit a missed target and updates the ballistic computer. This recalculation takes into account motion of the target determined by the target detect and track processor 18.

What is claimed is:

1. A method of correcting the alignment of a gun following the firing of a round at a target by the gun, the method comprising the steps of:

aiming the gull at the target and predicting an expected trajectory for a round to be fired;

firing the gun and monitoring the target and its surrounding area with an image sensor;

predicting a plurality of alternative round trajectories which encompass possible variations from said expected trajectory;

analysing image data generated by the image sensor to determine which of said alternative trajectories the fired round followed and, if it is determined that the fired round followed one of said alternative trajectories, determining a gun alignment factor from a comparison of said expected trajectory and said one of the alternative trajectories followed by the fired round.

2. A method as claimed in claim 1, wherein the image data generated by the image sensor provides a sequence of image frames which together form a video record of the travel of the fired round and said step of analysing the image data comprises normalising the frames to subtract stationery background therefrom and then for each said trajectory:

mapping the trajectory onto the two-dimensional plane of the image frames;

for each frame predicting the displacement of a round following the trajectory, relative to a fixed reference point;

translating the frames of the sequence relative to said fixed reference point by the respective predicted displacements;

summing the translated frames to generate a single cumulative frame;

identifying features present in the cumulative frame which exceed a threshold level and which have a form chosen to be indicative of a fired round.

3. A method as claimed in claim 2, wherein for the cumulative frame corresponding to the actual round trajectory, the fired round appears as a bright spot, having a gaussian intensity distribution and if for one of the trajectories a feature is identified in the cumulative image which exceeds said predetermined threshold then that trajectory is identified as the trajectory followed by the round, if features are so identified for a number of different trajectories, then the feature having the strongest intensity is selected and the associated trajectory identified.

4. A method as claimed in claim 1, wherein the image data provides a sequence of image frames which together form a video record of the travel of the fired round and wherein the step of analysing the image data comprises the steps of:

identifying a portion or patch of each frame predicted to contain the round, said patch having the same extent for each frame;

normalizing the patches to subtract stationary background therefrom:

and then for each of the trajectories:

mapping the trajectory onto the two-dimensional plane of each of the patches;

for each patch predicting a displacement of a round following the trajectory relative to a fixed reference point;

translating the patches of the sequence relative to said fixed reference point by the respective predicted displacements;

summing the translated patches to generate a single cumulative patch; and identifying features present in the cumulative patch which exceed a threshold level and which have a form indicative of a fired round, whereby it is only necessary to translate and sum the identified patches, considerably reducing the complexity of the image processing operation.

5. A method of determining the site of impact of a round fired by a gun at a target, the method comprising:

aiming the gun at the target and predicting an expected trajectory for a round to be fired, predicting a plurality of alternative round trajectories which encompass possible variations from the expected trajectory to identify an area surrounding the target where the round is likely to impact, monitoring the target and its surrounding area with an image sensor having an output that is recorded;

defining a threshold level of change in the output of the image sensor as being indicative of an impact of a round;

following the firing of the round, detecting a change in the output of the image sensor in excess of said defined threshold and identifying the region of change; and determining the centroid of said region of change and identifying this centroid as the site of impact of the fired round.

6. A method as claimed in claim 5, wherein the detected change in the output of the image sensor is determined relative to a preceding image frame in a sequence of image frames.

7. A method as claimed in claim 5, wherein the detected change in the output of the image sensor is determined relative to an image recorded prior to firing of the round.

8. A target hit assessment method for enabling a gun crew to determine the accuracy of a round fired by a gun, the method comprising:

aiming the gun at the target and predicting an expected trajectory for a round to be fired, predicting a plurality of alterative round trajectories which encompass possible variations From the expected trajectory, estimating prior to firing the possible variations in time-to-impact of the round, from properties of the round and the gun, prevailing atmospheric conditions and the predicted trajectories; and following firing of the gun, commencing recording of a video sequence of the target shortly before the estimated times-to-impact of the round and subsequently stopping recording shortly after the estimated times-to-impact; and playing back the recorded sequence at any appropriate rate on a video display to allow the accuracy of the firing to be quantified.

9. A method as claimed in claim 8, wherein the video sequence comprises less than 50 frames and the sequence is played back, slowed down by a factor of 20 or more.

10. A target hit assessment system for enabling a gun crew to determine the accuracy of a round fired by a gun, the system comprising:

an image sensor having a field-of-view capable of including an intended target;

computer means for predicting an expected trajectory for a round to be fired; for predicting a plurality of alternative round trajectories which encompass possible variations from the expected trajectories; and for estimating the possible variations in the time-to-impact of the round to be fired by the gun with reference to the time of firing of the gun;

video recording means coupled to the image sensor and arranged to record a video sequence from the image sensor commencing shortly before the estimated times-to-impact of a fired round and stopping shortly after the estimated times-to-impact; and video display means coupled to the video recording means for receiving therefrom said recorded video sequence for playback.

11. A method of correcting the alignment of a gun following the firing of a round at a target by the gun, the method comprising the steps of:

aiming the gun at the target and predicting an expected trajectory for a round to be fired;

firing the gun and monitoring the target and its surrounding area with an image sensor that generates image data in the form of a sequence of image frames which together form a video record of the travel of the fired round;

predicting a plurality of alternative round trajectories which encompass possible variations from said expected trajectory;

analyzing image data generated by the image sensor to determine which of said alternative trajectories the fired round followed and, if it is determined that the fired round followed one of said alternative trajectories, determining a gun alignment factor from a comparison of said expected trajectory and said one of the alternative trajectories followed by the fired round, wherein the image data is analyzed by normalizing the frames to subtract stationary background therefrom and then for each said trajectory:

mapping the trajectory onto the two-dimensional plane of the image frames;

for each frame predicting the displacement of a round following the trajectory, relative to a fixed reference point;

translating the frames of the sequence relative to said fixed reference point by the respective predicted displacements;

summing the translated frames to generate a single cumulative frame; and identifying features present in the cumulative frame which exceed a threshold level and which have a form indicative of a fired round.

* * * * *

UNITED STATES PATENT AND TRADEMARK OFFICE

CERTIFICATE OF CORRECTION

PATENT NO. : 6,260,466 B1
DATED : July 17, 2001
INVENTOR(S) : Humphreys

It is certified that error appears in the above-identified patent and that said Letters Patent is hereby corrected as shown below:

Column 8,
Line 48, "gull" should read -- gun --.

Column 10,
Line 17, "From" should read -- from --.

Signed and Sealed this

Fifteenth Day of January, 2002

*Attest:*

*Attesting Officer*

JAMES E. ROGAN
*Director of the United States Patent and Trademark Office*